United States Patent [19]

Schwab et al.

[11] 4,449,159

[45] May 15, 1984

[54] FOCUSING ELECTRODES FOR HIGH-INTENSITY IONIZER STAGE OF ELECTROSTATIC PRECIPITATOR

[75] Inventors: James J. Schwab, Seattle, Wash.; Owen J. Tassicker, Cupertino, Calif.

[73] Assignee: Electric Power Research Institute, Inc., Palo Alto, Calif.

[21] Appl. No.: 960,339

[22] Filed: Nov. 13, 1978

Related U.S. Application Data

[63] Continuation of Ser. No. 785,470, Apr. 7, 1977, abandoned.

[51] Int. Cl.[3] ..... B03C 3/00

[52] U.S. Cl. ..... 361/230; 55/138; 55/152; 55/154

[58] Field of Search ..... 55/2, 12, 127, 136–138, 55/148, 150–154; 361/226, 230

[56] References Cited

U.S. PATENT DOCUMENTS

| | | | |
|---|---|---|---|
| 916,746 | 3/1909 | Morscher | 55/13 |
| 1,322,163 | 11/1919 | Conover | 55/152 |
| 1,442,052 | 1/1923 | Dane | 55/151 |
| 2,409,579 | 10/1946 | Meston | 55/152 |
| 3,668,835 | 6/1972 | Vicard | 55/122 |
| 4,093,430 | 6/1978 | Schwab et al. | 55/150 |
| 4,194,888 | 3/1980 | Schwab et al. | 55/154 |

FOREIGN PATENT DOCUMENTS

| | | | |
|---|---|---|---|
| 413800 | 7/1934 | United Kingdom | 55/136 |

*Primary Examiner*—Bernard Nozick

*Attorney, Agent, or Firm*—Townsend & Townsend

[57] ABSTRACT

An improved electrode assembly for a high-intensity ionizer array utilized as the first stage in a two-stage electrostatic precipitator. Each ionizer unit employs a pair of co-axial electrodes to create a high-intensity electric field across the path of a particulate-laden gas stream. As the gas passes through the field, it is intensely ionized and the particulate becomes highly charged. The ionizer anode comprises a venturi diffuser through which the gas stream flows immediately prior to entry into a precipitator stage which removes the charged particles. The ionizer cathode is a disk co-axially mounted within the venturi throat and having an arcuate periphery. A high voltage power supply connected between the anode and cathode establishes a high-intensity corona discharge in the annular region formed between the edge of the cathode disk and the surrounding cylindrical anode surface. Focusing electrodes at cathode potential are positioned on either side of the cathode disk and intensify the electric field along the anode wall at the fringes of the current flux band upstream and downstream from the corona discharge plane. This substantially reduces the width of the anode surface subjected to corona current and minimizes anode cleaning requirements by reducing the particle deposition area.

11 Claims, 4 Drawing Figures

FOCUSING ELECTRODES FOR HIGH-INTENSITY IONIZER STAGE OF ELECTROSTATIC PRECIPITATOR

This is a continuation of application Ser. No. 785,470, filed Apr. 7, 1977 now abandoned.

ACKNOWLEDGEMENT

This invention was made under contract with or supported by the Electric Power Research Institute, Inc. of Palo Alto, Calif.

BACKGROUND OF THE INVENTION

1. Field of the Invention

The present invention relates to high-intensity ionizers which pre-charge particulate matter entrained in a contaminated gas stream prior to removal of the charged particles from the stream by electrostatic precipitation. More specifically, the invention is directed to an improved electrode configuration for a co-axial venturi ionizer wherein focusing electrodes narrow the width of the current flux band upstream and downstream of the ionizer discharge plane.

2. Description of the Prior Art

Standards for emissions of particulate in flue gases issuing from coal fired electrical power station stacks are becoming increasingly more stringent. Current air quality standards require that more than 99% of the fly ash produced by burning coal be removed prior to discharge of the combustion gases from the stack. Thus, the efficiency of particulate collection must increase in proportion to the ash content of the coal. In addition, in an effort to reduce the emission of certain gaseous pollutants, particularly the sulfur oxides, it has become increasingly necessary to use low sulfur coal in electrical power generating plants.

The electrostatic precipitator is the most commonly used device for the removal of particulate matter from power station stack gases. Because the size of an electrostatic precipitator is determined by the efficiency of fly ash removal required, an increase in required fly ash collection efficiency requires a corresponding increase in equipment size and cost. Moreover, because fly ash resistivity tends to be inversely related to the level of combustible sulfur in the coal burned, the use of low sulfur coals to directly reduce gaseous sulfur oxide emissions, produces highly resistive dusts. It has been demonstrated that the size of the electrostatic precipitator necessary to achieve a given level of collection efficiency increases with increasing electrical resistivity of the fly ash. The use of low sulfur coals therefore further increases the size and cost of the precipitator.

Recently, high-intensity ionizers have been developed in which a unique electrode geometry produces a stable high-intensity corona discharge through which the particulate-laden gas is passed. The ionized flue gases produced charge the particulate matter to a much higher level than is achievable with a conventional electrostatic precipitator. When the ionizer is followed with an electrostatic precipitator, the higher particle charge results in a higher collection efficiency in the precipitator due to higher migration or particle drift velocity. In such a two-stage arrangement, the ionizer acts as the charging stage and the precipitator serves as the collecting stage.

Such high-intensity ionizers utilize a co-axial pair of electrodes to generate a high-intensity field expanding radially and axially parallel to the direction of gas flow. The anode in such an arrangement typically takes the form of a venturi diffuser through which the stack gases flow immediately prior to entering the precipitator stage. The cathode is a disk co-axially mounted within the venturi throat and is formed with a curved peripheral edge having a radius much smaller than the inner radius of the venturi. When a high voltage power supply is connected between the anode and cathode, a high-intensity corona discharge is established is an annular region between the arcuate periphery of the cathode disk and the surrounding cylindrical anode surface face near the disk. Because the field is relatively narrow in the direction of gas flow, a high intensity field is achievable without prohibitive electrical power requirements. The combination of the high gas stream velocity through the venturi and the high intensity transverse electric field through which the gas stream passes produces intense ionization and very high levels of charge on the particles and results in increased collection efficiency notwithstanding the high resistivity of the particulate as in the case of fly ash from low sulfur coal.

One of the problems which has been encountered in connection with co-axial high intensity ionizers of the type described above results from the detrimental build-up of charged particles on the cylindrical anode wall near the corona discharge plane. Deposition of high resistivity particulate matter in this region results in the phenomena of back corona and excessive sparking with a resulting deterioration in the applied electric field and attendant degradation in particle charging efficiency. Prior attempts to overcome this problem have involved "cleaning" the anode surface in the affected region to eliminate disturbances in the corona due to contaminate build-up on the outer electrode. One form of anode cleaning involves the injection of clean gas into the venturi in the corona discharge region to form a protective barrier between the anode wall and the charged particles in the gas stream. One particularly effective clean gas injection system is described in copending application Ser. No. 785,469, filed Apr. 7, 1977 entitled "Vaned Anode For High Intensity Ionizer Stage of Electrostatic Precipitator," now U.S. Pat. No. 4,108,615, issued Aug. 22, 1978.

SUMMARY OF THE INVENTION

According to the present invention, anode cleaning requirements referred to above are reduced by substantially narrowing the width of the current flux band in the annular region between the cathode and anode. This effect is achieved by focusing electrodes on either side of the cathode disk which create higher electric fields at the fringes of the current flux band upstream and downstream of the ionizer discharge plane. The higher electric fields drive the ions to the anode with higher velocity with a consequent reduction of ion migration upstream and downstream by mutual repulsion. The net effect is that the width of the band on the anode surface which is subject to particle deposition is reduced substantially along with cleaning gas requirements.

The focusing electrodes are sized to provide a high electric field near the anode surface at the fringes of the current flux band by extending circular electrodes on either side of the cathode disk a distance approximately equal to the inter-electrode gap between the cathode periphery and surrounding anode wall. The downstream focusing electrode cylinder can be terminated beyond that distance by a hemispherical cap. The diameter of the focusing electrode cylinders is preferably between 20% and 40% of the anode inside diameter but not larger than the cathode diameter.

DETAILED DESCRIPTION OF THE PREFERRED EMBODIMENT

Figure 1:
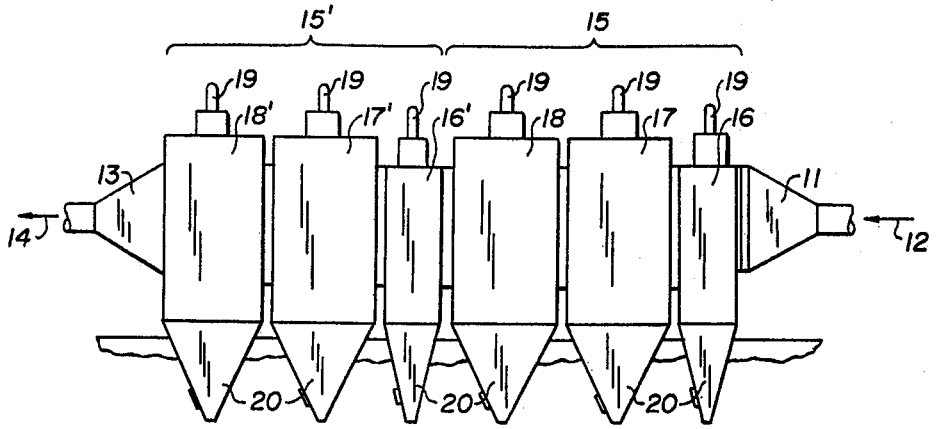
FIG. 1 is a schematic side elevational view illustrating a multi-stage electrostatic precipitator incorporating a high-intensity ionizer according to the present invention.

Turning now to the drawings, FIG. 1 shows in schematic side elevational view an electrostatic precipitator system incorporating the invention. As seen in this Fig., the precipitator system includes a gas inlet 11 into which gases to be cleaned are directed as suggested by arrow 12, a gas outlet 13 from which cleaned gases are supplied to appropriate downstream apparatus, e.g. an atmospheric discharge duct, as suggested by arrow 14, and typically a cascaded pair of ionizer-precipitator units generally designated by reference numerals 15, 15'. Each ionizer-precipitator unit 15, 15' includes an ionizer stage 16 (16') and typically a pair of conventional electrostatic precipitators 17, 18 (17', 18'). Each ionizer stage 16, 16' and precipitator stage 17, 17', 18, 18' is provided with a high voltage input connector 19 coupled to a suitable source of high voltage as described more fully below and a collecting bin portion 20 for collecting particulate matter precipitated from the gas as the latter flows through units 15, 15'.

In operation, gases containing particulate matter enter the FIG. 1 apparatus via inlet 11 and pass through the first ionizer stage 16 in which the particles in the gas are electrostatically charged. The gas bearing the electrostatically charged particles next flows into successive precipitator stages 17, 18 in each of which the charged particles are deflected out of the flow path of the gas under the influence of an electrical field established across the flow path, the particles being deposited in the bin portions 20 of the precipitator stages 17, 18. The gas exiting from precipitator 18 is passed through ionizer stage 16', and precipitator stages 17', 18', to provide additional cleaning therefor, and the cleaned gases emerging from precipitator stage 18' are conducted via gas outlet 13 to appropriate downstream apparatus.

Figure 2:
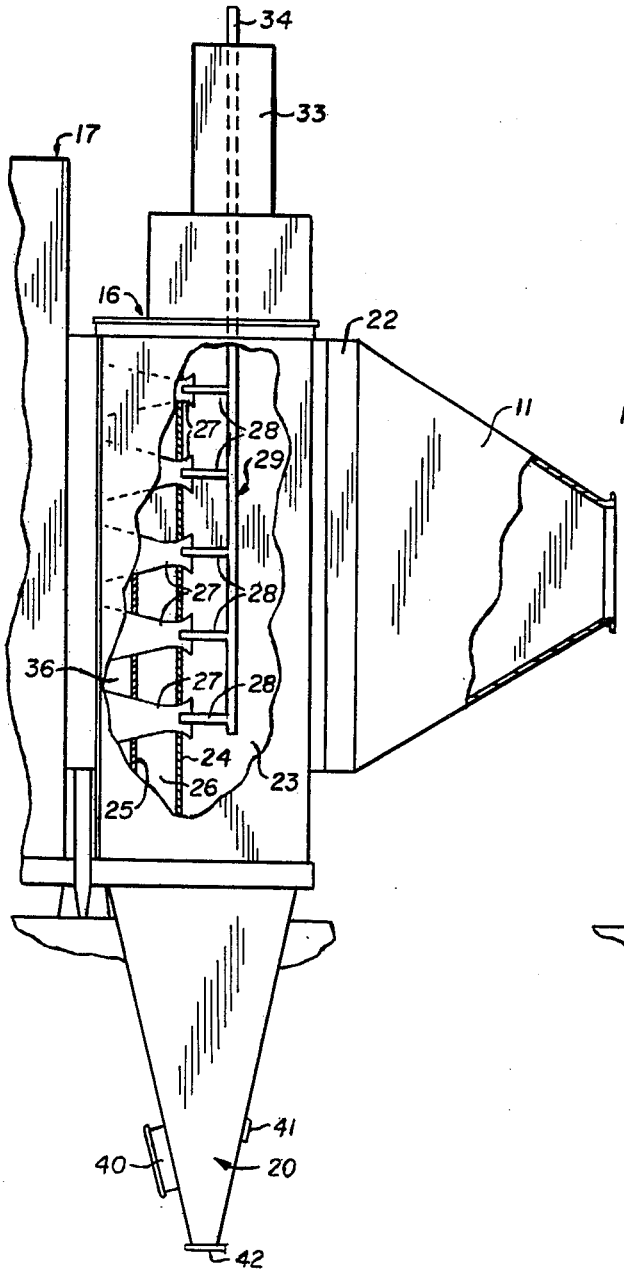
FIG. 2 is an enlarged side view of one ionizer stage of the apparatus of FIG. 1 partially broken away to show the ionizer array.
Figure 3:
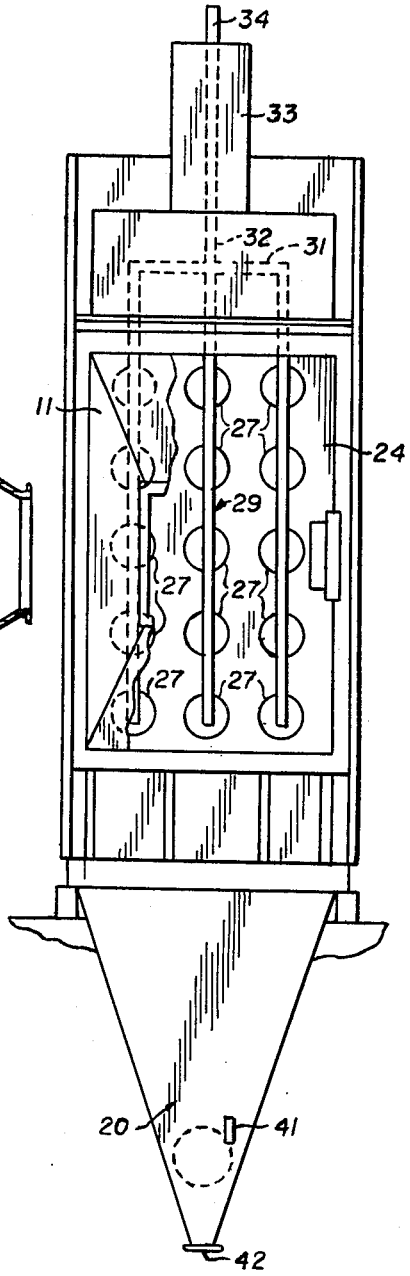
FIG. 3 is an end elevational view of the ionizer stage of FIG. 2 with the inlet partially broken away to show the ionizer array.

FIGS. 2 and 3 typically illustrate the gas inlet 11 and the first ionizer stage 16 with more detail. As seen in these Figs., gas inlet 11 comprises a hollow conduit or trapezoidal or other suitable geometric configuration which is coupled at the downstream side to a gas distributor portion 22. Distributor portion 22 is coupled to an entry chamber 23 formed within the housing of ionizing unit 16 by the side and bottom walls thereof and a vertically arranged bulkhead 24.

Positioned within ionizer stage 16 in a regular array are a plurality of venturi diffusers 27 and associated central electrode support members 28 each projecting into either end of the associated venturi 27 (shown here upstream) and substantially coaxially therewith. Each member 28 is coupled to a bus bar network generally designated by reference numeral 29 and consisting of vertically arranged parallel bus bars (three shown here) interconnected at the upper ends thereof by a common bus bar element 31, the element 31 being connected to a single bus bar element 32 extending from the interior of ionizer stage 16 to an external conventional high voltage connector shroud 33 to which a high voltage is supplied from a suitable power source (not shown) via high voltage connector 34. The downstream end or outlet of each venturi 27 is coupled to an exit chamber 36 which is in turn coupled to the inlet of electrostatic precipitator stage 17.

Storage bin 20 is provided with a removable door 40 for purposes of inspection and cleaning, and a vibrator bracket 41 for permitting the use of an optional conventional vibrator to assist in settling any particulate matter collecting in bin 20 towards the bottom edge 42 thereof. Bottom edge 42 is provided with suitable apertures (not shown) for enabling the particulate matter to be removed from the bin 20 in a conventional manner. Bins 20 of the remaining system elements 16', 17, 17', 18, and 18' are configured in a substantially identical manner.

Each venturi element 27 and associated coaxial member 28 generally comprises an electrode pair for generating a high intensity electric field across the path of gas flow through the ionizer stage 16. For this purpose, an electrode (described below) is carried by each member 28 and is coupled to a source of relatively high negative potential, via bus bar network 29 while each venturi conduit 27 is coupled via the framework of the structure to ground potential. Thus each venturi 27 serves as an anode and each member 28 serves as a cathode support.

In operation, with high voltage applied between the cathode and anode, particles suspended in any gas flowing through the ionizer stage 16 are electrostatically charged when passing through the throat of venturi 27. In order to ensure that substantially all charged particles remain suspended in the flowing gas until arriving at the downstream precipitator 17 or 18, and do not adhere to the ground potential anode surface, the novel electrode configuration shown in FIG. 4 is employed.

Figure 4:
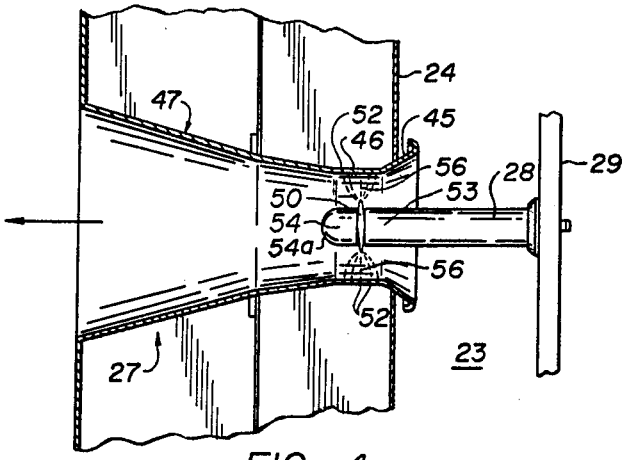
FIG. 4 is an enlarged partial sectional view of a single ionizer venturi illustrating the electrode arrangement.

With reference to FIG. 4, each venturi element 27 is formed with an inwardly tapering conical inlet section 45, a generally cylindrical central section or throat 46 and an outwardly tapering conical outlet portion 47. The cathode includes a conducting disk 50 having a curved peripheral edge which projects outwardly from the outer surface of member 28. Disc 50 is mounted substantially coaxially in the throat of venturi 27 and provides a highly constricted high-intensity electric field in the form of a corona discharge between the curved periphery of disk 50 and the surrounding anode surface 52 when a high potential is applied.

Mounted on either side of cathode disk 50 are focusing electrodes 53 and 54. These electrodes are preferably of cylindrical cross-section and are co-axial with cathode disk 50. Electrodes 53 and 54 are mounted to be in electrical contact with cathode disk 50 and thus are at cathode potential. Upstream focusing electrode 53 may be formed by appropriately sizing electrode support member 28 and maintaining electrical continuity between cathode disk 50, member 28, and bus bar 29. In this case, the downstream end of support member 28 functions as the upstream focusing electrode 53. Downstream focusing electrode 54 may be formed as an extension of support member 28 which extends a sufficient distance downstream of cathode disk 50 and is preferably terminated by a hemispherically shaped end surface 54*a*. Electrode 54 may be attached to electrode 53 by a threaded stud projecting from electrode 54 and passing through the center of cathode disk 50 into support member 28.

Focusing electrodes 53 and 54 increase the strength of the electric field at the fringes of the discharge current flux band (indicated at 56) upstream and downstream of the ionizer discharge plane. The increased electrical field in these areas drives the ions to the anode with higher velocity. Therefore, the ions migrate less upstream and downstream in their expansion by mutual repulsion. The net effect is that the width of the current flux band impinging on the anode surface is reduced substantially and the amount of anode surface which must be cleaned is similarly reduced. This in turn reduces cleaning gas requirements and results in an overall increase in particulate collection efficiency.

Focusing electrodes 53 and 54 extend upstream and downstream from cathode disk 50 a distance approximately equal to the inter-electrode separation between the periphery of cathode disk 50 and the surrounding anode wall. For purposes of the invention, the focusing electrode cylinders can be terminated beyond that distance if desired such as by hemispherically capping the downstream cylinder 54 as described above to prevent corona leakage there, however, extension of the electrode beyond that distance will still provide satisfactory results as indicated by the fact that the physical structure of electrode 53 is formed in the depicted embodiment by cathode support element 28 which extends out of the inlet side of venturi 27 terminating at bus bar 29.

The diameter of the focusing electrode cylinders is preferably between 0.2 and 0.4 of the inside diameter of the anode surface surrounding cathode disk 50. If the diameter is larger or smaller the electric field at the focusing electrode surface is increased promoting surface corona leakage. However, even outside the preferred range, focusing electrodes of the present invention provide improved performance as compared with prior art devices not employing such electrodes.

While a preferred embodiment of the present invention has been shown and described above, it will be readily apparent to those skilled in the art that numerous modifications and adaptations thereof may be made without departing from the spirit and scope of the invention as defined by the following claims.

What is claimed is:

1. A high-intensity gas ionizer for an electrostatic precipitator comprising:

venturi means for connecting a source of particulate laden gases with the electrostatic precipitator wherein a gas flow occurs through the venturi means;

a discharge electrode comprising a disk mounted within the throat of the venturi means and having a peripheral edge defining a maximum dimension transverse to the direction of the gas flow;

voltage means interconnected between the discharge electrode and the venturi means to establish a high-intensity electric field within the venturi means across the gas flow, the peripheral edge of the discharge electrode having at least one profile of sufficient curvature that the electric field establishes a corona current in a region between the discharge electrode and the venturi means; and first and second cylindrical focusing electrodes mounted along the direction of the gas flow within the venturi means, extending coaxially in first and second directions away from the discharge electrode, said first focusing electrode extending upstream from said discharge electrode disk beyond said venturi means and said second focusing electrode extending downstream from said discharge electrode disk and terminating in a hemispherical cap, said first and second focusing electrodes being electrically coupled to the discharge electrode and maintained at approximately the same electrical potential as the discharge electrode, having respective diameters less than the maximum transverse dimension of the discharge electrode, and being sized so that corona discharge from the focusing electrodes is substantially non-existent; the first and second focusing electrodes being sized to increase the electric field strength at the fringes of the region of corona current to axially limit the region of corona current and thus reduce the surface area of the venturi means subjected to collection of particulates in the gases.

2. The invention of claim 1 wherein the diameters of the first and second focusing electrodes are equal, and are between 0.2 and 0.4 of the inside diameter of the surface of the venturi means surrounding the discharge electrode.

3. The invention of claim 2 wherein the focusing electrodes extend from either side of the discharge electrode disk a distance at least equal to the distance between the disk periphery and the surrounding surface of the venturi means.

4. The invention of claim 3 wherein the voltage means maintains the discharge electrode at a negative potential relative to the venturi means.

5. A high-intensity gas ionizer for an electrostatic precipitator comprising:

venturi means for establishing a flow of particulate laden gas into the electrostatic precipitator;

a discharge electrode disk mounted coaxially within the throat of the venturi means and having an arcuate periphery defining a disk diameter;

voltage means interconnected between the discharge electrode disc and the venturi means to establish a high-intensity electric field therebetween across the path of the particulate laden gases, the discharge electrode disk having a profile of sufficient curvature such that the electric field establishes a corona current in a region between the arcuate periphery and the venturi means; and first and second cylindrical focusing electrodes mounted coaxially within the venturi means, extending coaxially in the first and second directions away from the discharge electrode disk, being electrically coupled to the discharge electrode disk and maintained at approximately the same electrical potential as the discharge electrode disk;

the first and second cylindrical focusing electrodes having respective diameters that are less than the disk diameter, and being sized so that corona discharge from the cylindrical focusing electrodes is substantially non-existent;

the first cylindrical focusing electrode extending upstream from the discharge electrode disk a distance at least equal to the distance between the disk periphery and the venturi means;

the second cylindrical focusing electrode extending downstream from the discharge electrode disk a distance at least equal to the distance between the disk periphery and the surrounding surface of the venturi means and terminating in a hemispherical cap;

such that the first and second cylindrical focusing electrodes increase the electric field strength at the fringes of the region of the corona current, whereby the inside surface area of the venturi means that is subjected to collection of the particulates in the gases is reduced.

6. The invention of claim 5 wherein the diameters of the first and second focusing electrodes are equal and between 0.2 and 0.4 of the inside diameter of the surface of the venturi means surrounding the discharge electrode disk.

7. The invention of claim 5 wherein the first cylindrical focusing electrode extends beyond the venturi means.

8. The invention of claim 5 wherein the voltage means maintains the discharge electrode disk at a negative potential relative to the venturi means.

9. A high-intensity gas ionizer comprising:

a venturi through which particulate laden gas may flow;

a single discharge electrode comprising a disk mounted within the throat of the venturi and having a peripheral edge defining a maximum dimension transverse to the direction of the gas flow;

voltage means interconnected between the discharge electrode and the venturi to establish a high-intensity electric field within the venturi across the gas flow, the peripheral edge of the discharge electrode having at least one profile of sufficient curvature that the electric field establishes a corona current in a region between the discharge electrode and the venturi; and first and second cylindrical focusing electrodes mounted along the direction of the gas flow within the venturi, extending coaxially in first and second directions away from the discharge electrode, said first focusing electrode extending upstream from said discharge electric disk beyond the venturi, and said second focusing electrode extending downstream from said discharge electrode disk and terminating in a hemispherical cap, said first and second focusing electrodes being electrically coupled to the discharge electrode and maintained at approximately the same electrical potential as the discharge electrode, having respective diameters less than the maximum transverse dimension of the discharge electrode, and being sized so that corona discharge from the focusing electrodes is substantially non-existent; the first and second focusing electrodes being sized to increase the electric field strength at the fringes of the region of corona current to axially limit the region of corona current and thus reduce the surface area of the venturi subjected to collection of particulates in the gas.

10. The invention of claim 9 wherein the diameters of the first and second focusing electrodes are equal, and are between 0.2 and 0.4 of the inside diameter of the surface of the venturi surrounding the discharge electrode.

11. The invention of claim 10 wherein the focusing electrodes extend from either side of the discharge electrode disk a distance at least equal to the distance between the disk periphery and the surrounding surface of the venturi.

* * * * *